US005288014A

United States Patent [19]

Meyers et al.

[11] Patent Number: 5,288,014

[45] Date of Patent: Feb. 22, 1994

[54] TWO-WAY MAILER

[75] Inventors: Richard A. Meyers; Nelson N. Lusiner, both of Troy, Mich.

[73] Assignee: The Standard Register Company, Dayton, Ohio

[21] Appl. No.: 847,589

[22] Filed: Mar. 5, 1992

[51] Int. Cl.[5] ..... B65D 27/04; B65D 27/06

[52] U.S. Cl. ..... 229/304; 229/70; 229/71

[58] Field of Search ..... 229/303, 304, 70, 71

[56] References Cited

U.S. PATENT DOCUMENTS

| | | | |
|---|---|---|---|
| 1,957,704 | 5/1934 | Drachman | 229/305 |
| 2,759,658 | 8/1956 | Sawdon | 229/305 |
| 2,910,222 | 10/1959 | Bermingham, Jr. et al. | 229/303 |
| 2,928,583 | 3/1960 | Law | 229/305 |
| 3,652,007 | 3/1972 | Mac Dougall | 229/304 |
| 3,802,618 | 4/1974 | Wiessner | 229/304 |
| 3,952,942 | 4/1976 | O'Leary et al. . | |
| 4,081,127 | 3/1978 | Steidinger . | |
| 4,089,418 | 5/1978 | Yale | 229/303 |
| 4,524,903 | 6/1985 | Vath . | |
| 4,668,211 | 5/1987 | Lubotta et al. . | |
| 4,682,793 | 7/1987 | Walz . | |
| 4,754,915 | 7/1988 | Steidinger . | |
| 4,778,100 | 10/1988 | McGuire et al. . | |
| 4,778,101 | 10/1988 | Paquin . | |
| 4,779,792 | 10/1988 | Lombardo . | |
| 4,889,278 | 12/1989 | Steidinger . | |
| 4,896,823 | 1/1990 | Taylor | 229/92.3 |
| 4,944,449 | 7/1990 | Schmidt . | |
| 4,944,450 | 7/1990 | Schmidt . | |
| 4,951,864 | 8/1990 | Dicker . | |

*Primary Examiner*—Stephen P. Garbe

*Attorney, Agent, or Firm*—Killworth, Gottman, Hagan & Schaeff

[57] ABSTRACT

A mailer product is provided which is formed from a single sheet of paper having first, second and third sections. The first and second sections are separated by a first transverse line and the second and third sections are separated by a second transverse line. The sheet of paper is foldable along the first and second transverse lines so that the first section overlies the second section and the third section overlies the first and second sections. First adhesive material is provided on one of the first and the second sections of the sheet for securing the first and the second sections to one another when the sheet is folded along the first transverse line, thereby forming a return envelope. Second adhesive material is located on at least one of the first, second and third sections for securing the third section to at least one of the first and the second sections when the sheet is folded along the second transverse line, thereby forming a closed mailer. A method and apparatus is further provided for forming such a one-piece mailer.

9 Claims, 9 Drawing Sheets

FIG-5
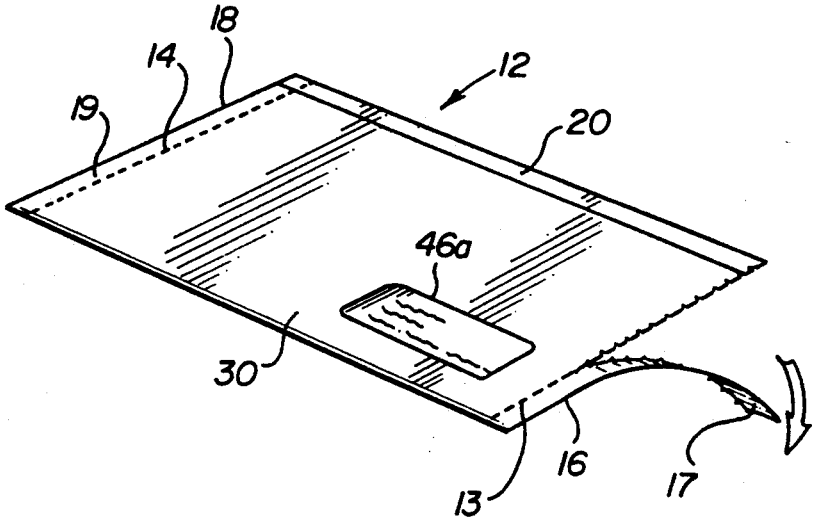
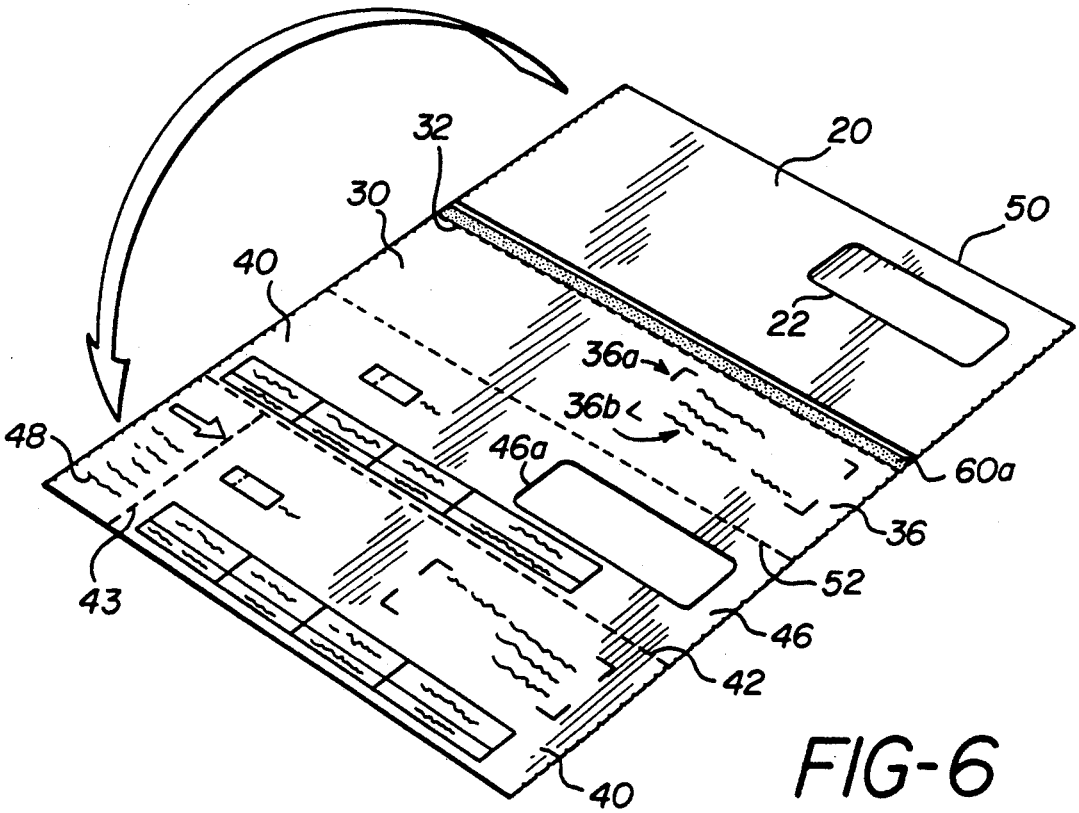
FIG-6

FIG-7
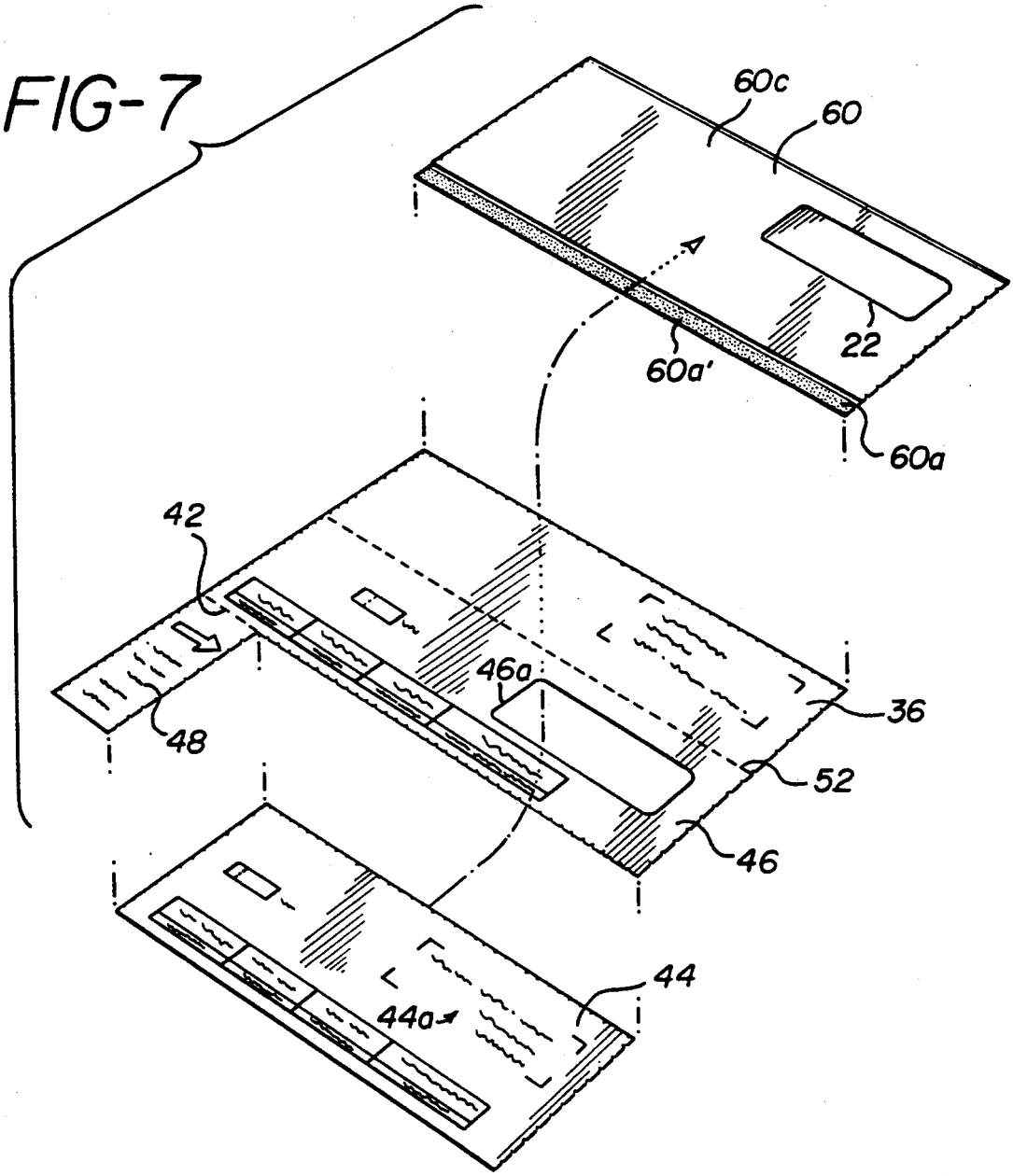
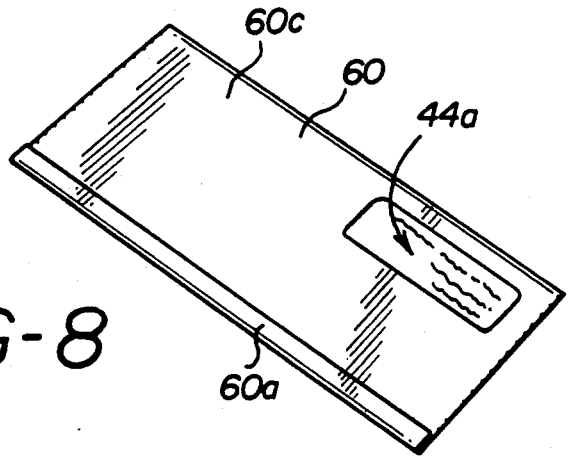
FIG-8

145
149
147
187
100
112
116
113
110
122
114
114a
114b
120
130
134
132
10a
10
10b
138
136
118b
118
118c
118a
120d
124
174

TWO-WAY MAILER

BACKGROUND OF THE PRESENT INVENTION

The present invention relates to a two-way mailer formed from a single sheet of paper. The present invention further relates to a method and apparatus for forming such a two-way mailer.

In many types of business activities it is desirable to employ the use of a mailer unit which can be mailed by a sender to a recipient and which can be used by the recipient for transmission of material to the sender or to another person.

Many types of mailer structures have been created in the past for use as two-way mailers. However, many of such mailer units have been relatively difficult and/or expensive to produce. For example, many two-way mailers are constructed from two or more sheets of paper, requiring that the sheets be collated and secured together. Because the sheets must be collated and secured to another, the manufacturing cost of such mailers is substantially high.

Another problem associated with two-way mailers is that many have been difficult for the recipient to open and/or to place in condition for remailing. A further problem is that many have not been attractive in appearance.

Accordingly, there is a need for an improved two-way mailer which is constructed from a single sheet of paper, is easy to open and to place in condition for remailing, and is attractive in appearance.

SUMMARY OF THE PRESENT INVENTION

The present invention addresses the limitations of prior art mailer units by offering a two-way mailer which is constructed from a single sheet of paper, is easy to open and place in condition for remailing, is attractive in appearance, and has improved utility. The present invention further provides a method and apparatus for forming such a two-way mailer.

In accordance with a first aspect of the present invention, a one-piece mailer is provided which can be easily opened and prepared for remailing by a recipient. The mailer is constructed from a single sheet of paper having first, second and third sections. The first and second sections are separated by a first transverse line and the second and third sections are separated by a second transverse line. The sheet of paper is foldable along the first and second transverse lines so that the first section overlies the second section and the third section overlies the first and second sections. First securing means are provided on one of the first and the second sections of the sheet for securing the first and the second sections to one another when the sheet is folded along the first transverse line, thereby forming a return envelope. Second securing means are located on at least one of the first, second and third sections for securing the third section to at least one of the first and the second sections when the sheet is folded along the second transverse line, thereby forming a closed mailer. The single sheet of paper further includes first and second outer longitudinal tear lines extending along opposite first and second side edges of the sheet.

The second section of the sheet of paper includes a first severance line extending across its width and spaced parallel to the first and second transverse lines for defining first and second portions of the second section. The first portion includes a sealing panel and a first side of the return envelope. The first section of the sheet defines the second side of the return envelope. The sealing panel includes third securing means for securing the sealing panel to the second side of the return envelope for sealing the same closed. The second portion preferably includes an initial addressee portion having initial addressee information printed thereon. The return envelope is severable from the second portion of the second section along the first severance line.

The third section preferably includes a second severance line for defining a return portion and a window portion. The return portion has return addressee information printed thereon and the window portion includes a cut-out window through which the initial addressee information on the second section is visible when the third section overlies the first and the second sections. The return portion of the third section may additionally include payment information printed thereon, and the window portion may further include receipt information printed thereon.

The first section may also include a cut-out window through which the return addressee information on the third section is visible when the return portion is separated from a remaining portion of the third section and the return portion is inserted into the return envelope.

The first securing means comprises first and second lines of adhesive located on the second section. The first line of adhesive is positioned inwardly of and adjacent to the first longitudinal tear line and the second line of adhesive is positioned inwardly of and adjacent to the second longitudinal tear line. The second securing means comprises third and fourth lines of adhesive located on the third section for detachably securing the third section to the first and second sections. The third line of adhesive is positioned intermediate the first longitudinal tear line and the first side edge of the sheet and the fourth line of adhesive is positioned intermediate the second longitudinal tear line and the second side edge of the sheet. The second securing means further comprises adhesive material located on a back surface of the first section. Alternatively, the third and fourth lines of adhesive may extend onto at least a portion of the second section.

In accordance with a second aspect of the present invention, a method is provided for forming a one-piece mailer. The method comprises the steps of: providing a single sheet of paper having first, second and third sections, the first and second sections being separated by a first transverse line and the second and third sections being separated by a second transverse line; applying first adhesive material on one of the first and second sections; applying second adhesive material on at least one of the first, second and third sections; folding the sheet of paper along the first transverse line so that the first section overlies the second section with the first adhesive material interposed therebetween for securing the first and the second sections to one another to form a return envelope; and, folding the sheet of paper along the second transverse line so that the third section overlies the first and the second sections with the second adhesive material interposed therebetween for securing the third section to the first and second sections to form a closed mailer.

The method preferably further comprises the steps of: including an initial addressee portion preprinted with initial addressee information on the second section; defining a window on the third section through which the initial addressee information is visible when the third section overlies the first and second sections; including a return portion preprinted with return addressee information on the third section; and, defining a window on the first section through which the return addressee information is visible when the return portion is separated from a remaining portion of the third section and inserted into the return envelope. The method additionally comprises the step of forming first and second outer longitudinal tear lines on the sheet of paper extending along opposite side edges of the sheet.

Preferably, the first securing means comprises first and second lines of adhesive and the second securing means comprises third and fourth lines of adhesive as set forth above with regard to the first aspect of the present invention.

In accordance with a third aspect of the present invention, a glue system is provided for applying first and second closely spaced lines of adhesive on a sheet of paper. The glue system is usable in a folder/gluer apparatus capable of folding and gluing a sheet of paper into a mailer product. The glue system comprises: first glue means for applying a first line of adhesive on a sheet of paper, second glue means for applying a second line of adhesive on the sheet of paper, and means for mounting the first and second glue means in a staggered relationship to allow the first and second glue means to apply the lines of adhesive in close proximity to one another.

The mounting means preferably comprises a plurality of brackets for mounting the first and the second glue means in a vertically staggered relationship. The brackets may additionally mount the first and second glue means in a longitudinally staggered relationship.

The first glue means includes a first glue solenoid having a diameter of a first dimension, and the second glue means includes a second glue solenoid having a diameter of a second dimension. Because the brackets are capable of mounting the first and second glue means in a staggered relationship, the first and second lines of adhesive may be separated from one another by a distance which is less than half the sum of the first and second dimensions.

According to preferred embodiments, it is an object of the present invention to provide a two-way mailer which is constructed from a single sheet of paper. It is a further object of the present invention to provide a two-way mailer that is easy to open and place in condition for remailing. It is an additional object of the present invention to provide a two-way mailer that is attractive in appearance, and has improved utility. It is another object of the present invention to provide a method and apparatus for forming a two-way mailer which is constructed from a single sheet of paper. Yet another object of the present invention is to provide a glue system for applying first and second closely spaced lines of adhesive on a sheet of paper. These and other objects and advantages of the invention will be apparent from the following description, the accompanying drawings and the appended claims.

BRIEF DESCRIPTION OF THE DRAWINGS

FIG. 5 is a perspective view illustrating removal of one of the marginal side edge portions of the mailer for opening the same;

FIG. 6 is a perspective view illustrating an opened mailer;

FIG. 7 is a perspective view of the opened mailer of FIG. 6 with the return envelope separated from the remaining portion of the second section and with the return portion, which is insertable within the return envelope, separated from the remaining portion of the third section;

FIG. 8 is a perspective view showing the return envelope sealed with the return portion therein;

DETAILED DESCRIPTION OF THE INVENTION

Figure 1:
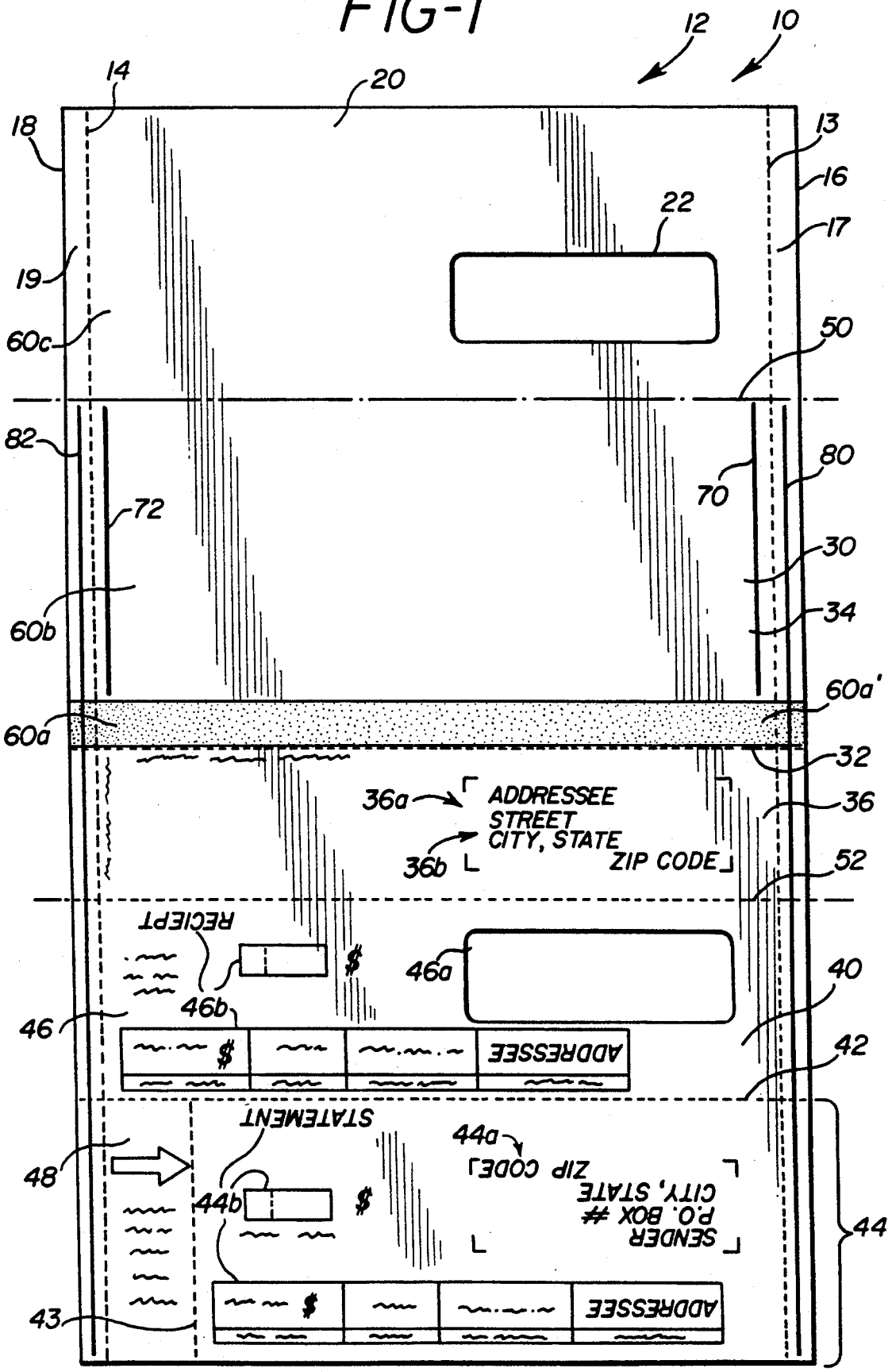
FIG. 1 is a plan view illustrating a single sheet of paper having first and second securing means thereon for use in forming a folded two-way mailer in accordance with the present invention.

FIG. 1 illustrates a single sheet of paper 10 from which a two-way mailer 12 of the present invention is constructed. The sheet of paper 10 includes a first section 20, a second section 30, and a third section 40. The first and second sections 20 and 30 are separated by a first transverse fold line 50, and the second and third sections 30 and 40 are separated by a second transverse fold line 52. The mailer 12 further includes first and second outer longitudinal tear lines 13 and 14 extending along first and second side edges 16 and 18 of the sheet 10 for defining first and second marginal edge portions 17 and 19. As will be discussed in further detail below, the sheet of paper 10 is foldable along the first and second transverse lines 50 and 52 so that the first section 20 overlies the second section 30 and the third section 40 overlies the first and second sections 20 and 30.

Figure 2:
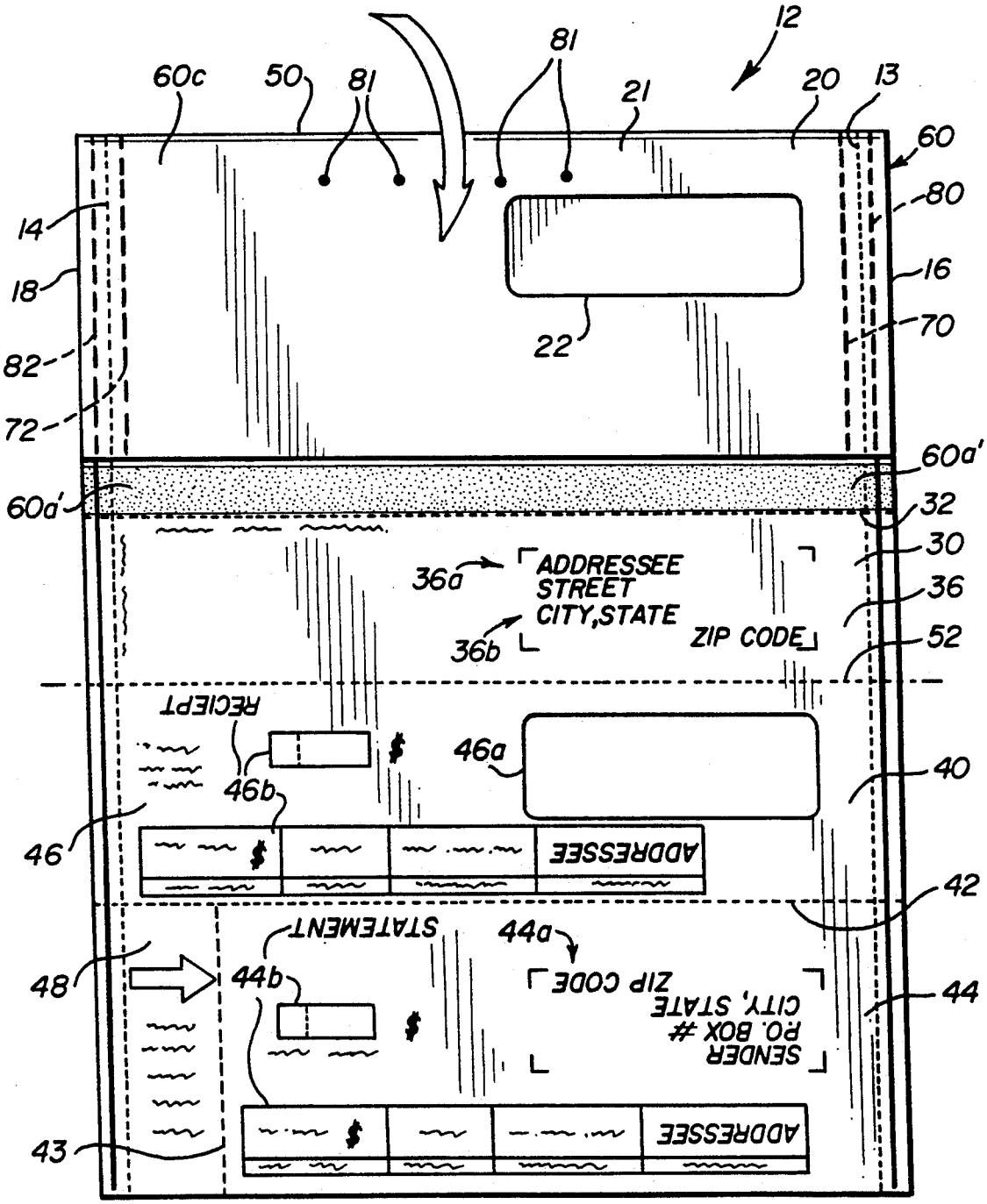
FIG. 2 is a plan view illustrating the sheet of paper of FIG. 1 folded along a first transverse line so that the first section of the sheet overlies the second section of the sheet to form a return envelope.

The second section 30 includes a first severance or perforation line 32 extending across its width and spaced parallel to the first and second transverse lines 50 and 52 for defining first and second portions 34 and 36 of the second section 30. The first portion 34 includes a sealing panel **60*a* and a first side 60*b* of a return envelope 60. The second side 60*c* of the return envelope 60 is defined by the first section 20 of the sheet 10. As will be discussed in further detail below, the return envelope 60 is formed by folding the sheet 10 along the first transverse line 50, as shown in FIG. 2, and securing the first section 20 with the second section 30. The return envelope 60 is severable from the second portion 36** along the first severance line 32. The second portion 36 preferably includes an initial addressee portion 36a having initial addressee information 36b printed thereon.

A second severance or perforation line 42 is provided on the third section 40 for defining a return portion 44 and a window portion 46. The return portion 44 has return addressee information 44a printed thereon, and the window portion 46 includes a window 46a die-cut or otherwise formed therein through which the initial addressee information 36b on the second section 36 is visible when the third section 40 overlies the first and the second sections 20 and 30, see FIG. 3. The window 46a may be covered by transparent material (not shown) secured to the window portion 46. The return portion 44 may additionally include payment information 44b printed thereon, and the window portion 46 may further include receipt information 46b printed thereon.

The first section 20 also includes a cut-out window 22 through which the return addressee information 44a on the third section 40 is visible when the return portion 44 is separated from the window portion 46 and a further portion 48 of the third section 40 and the return portion 44 is inserted into the return envelope 60, see FIG. 8. The return portion 44 may be separated from portions 46 and 48 via perforated line 42 and perforated line 43. Receipt portion 46 may then be separated from portion 48 and the second section 30 via lines 42 and 52.

First securing means comprising first and second lines of adhesive 70 and 72, respectively, are provided on the second section 30 for securing the first and the second sections 20 and 30 to one another when the sheet 10 is folded along the first transverse line 50, as shown in FIG. 2. The secured first and second sections 20 and 30 form return envelope 60 which can be used by the initial addressee for transmission of material, such as return portion 44, to the sender or to another person. The first line of adhesive 70 is positioned inwardly of and adjacent to the first longitudinal tear line 13 and the second line of adhesive 72 is positioned inwardly of and adjacent to the second longitudinal tear line 14. Alternatively, the first and second lines of adhesive 70 and 72 may be positioned on the first section 20 or may be positioned on both the first and second sections 20 and 30.

Figure 3:
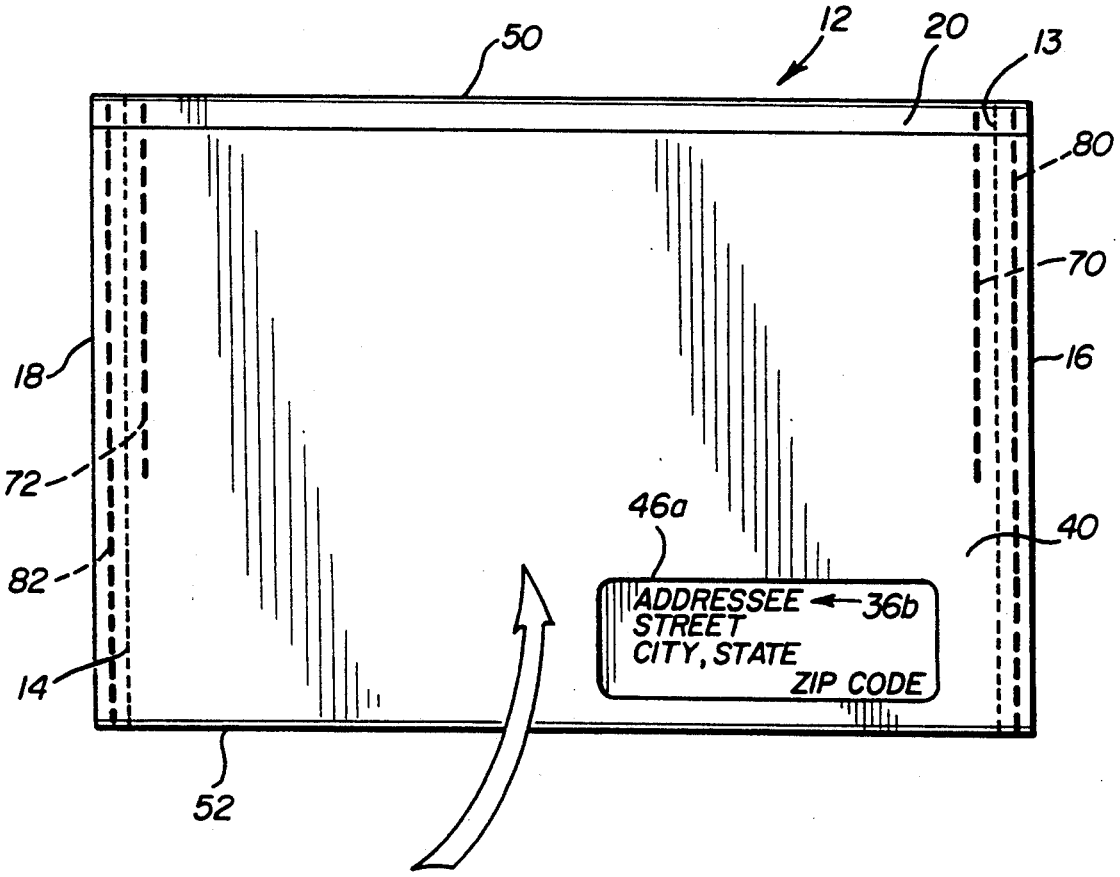
FIG. 3 is a plan view illustrating the sheet of paper of FIG. 2 folded along a second transverse line so that the third section overlies the first and second sections to form a folded two-way mailer in accordance with the present invention.

Second securing means comprising third and fourth lines of adhesive 80 and 82, respectively, are located on the second and third sections 30 and 40 of the sheet 10, as shown in FIG. 1, for detachably securing the third section 40 to the first and the second sections 20 and 30 when the sheet is folded along the second transverse line 52. The first, second and third sections 20, 30, and 40, upon being folded and secured to one another, as shown in FIG. 3, form a folded mailer 12 in accordance with the present invention. The third line of adhesive 80 is positioned on the first marginal edge portion 17 intermediate the first longitudinal tear line 13 and the first side edge 16 of the sheet 10, and the fourth line of adhesive 82 is positioned on the second marginal edge portion 19 intermediate the second longitudinal tear line 14 and the second side edge 18 of the sheet 10.

Figure 4:
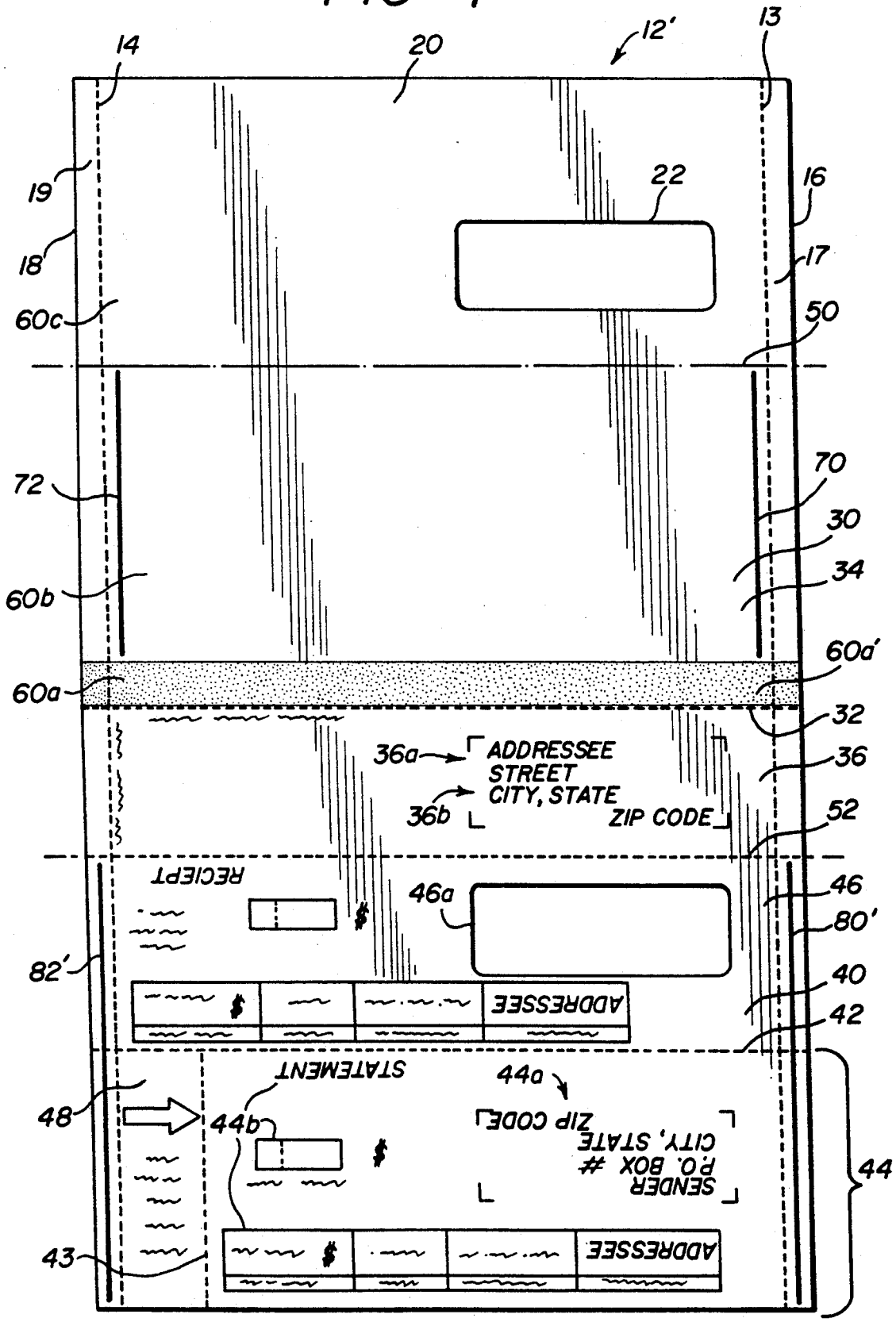
FIG. 4 is a plan view illustrating a single sheet of paper having first and second securing means thereon for use in forming a folded two-way mailer in accordance with an alternative embodiment of the present invention.

As shown in FIG. 4, it is further contemplated by the present invention that the sheet 10 may alternatively include third and fourth lines of adhesive 80' and 82', respectively, located on only the third section 40 of the sheet 10 for detachably securing the third section 40 to the first section 20 when the sheet 10 is folded along the second transverse line 52.

Referring again to FIG. 2, the second securing means further comprises adhesive material 81 located at spaced apart locations on a back surface 21 of the first section 20. The adhesive material employed for forming lines of adhesive 70, 72, 80 and 82, and the adhesive material 81 located on the back surface 21 of the first section 20, preferably comprises conventional water-base adhesive material.

The sealing panel 60a, as shown in FIG. 1, is coated with conventional heat resistant remoist glue material 60a'. The glue material 60a serves to secure the panel 60a to the second side 60c of the return envelope 60 for sealing the envelope 60 closed, as shown in FIG. 8.

The method for forming the two-way mailer 12 of the present invention will now be described. Initially, a single sheet of paper, such as shown in FIG. 1, is provided having appropriate initial addressee information 36b, return addressee information 44a, and any other desired information printed thereon. First and second lines of adhesive 70 and 72 are applied onto the second section 30 of the sheet 10 adjacent to and inwardly of the first and second longitudinal tear lines 13 and 14. Third and fourth lines of adhesive 80 and 82 are also are applied onto the sheet 10 along the first and second marginal edge portions 17 and 19 of the sheet 10, as shown in FIG. 1 or FIG. 4. The sheet 10 is then folded along the first transverse line 50 so that the first section 20 overlies the second section 30. The lines of adhesive 70 and 72 interposed therebetween serve to secure the two sections 20 and 30 together to form a return envelope 60, as shown in FIG. 2. Adhesive material 81 is then applied at space apart locations on the back surface 21 of the first section 20, as shown in FIG. 2. Thereafter, the sheet of paper 10 is folded along the second transverse line 52 so that the third section 40 overlies the first and second sections 20 and 30. The lines of adhesive 80 and 82 and the adhesive material 81 serve to secure the third section 40 to the first and second sections 20 and 30 when the third section 40 overlies sections 20 and 30, thereby forming a folded mailer 12, as shown in FIG. 3.

In order to open the mailer 12, the marginal edge portions 17 and 19 are removed via the longitudinal tear lines 13 and 14, such as shown in FIG. 5. The sheet 10 is then unfolded along the transverse line 52, as shown in FIG. 6, so that the third section 40 no long overlies the first and second sections 20 and 30.

After the mailer 12 has been opened, the return envelope 60 is removed from the second portion 36 of the second section 30 along severance line 32, as shown in FIG. 6. The return portion 44 is also removed from the remaining portions of the third section 40 along severance lines 43 and 42. The return portion 44 is then inserted, along with any other desired items, e.g., a payment check, into the return envelope 60, as shown in FIG. 7. The return portion 44 is inserted so that the return addressee information 44a is visible through window 22 in the envelope 60, see FIG. 8. Remoist glue material 60a' on the sealing panel 60a is then moistened and the panel 60a is folded over and secured to the second side 60c of the envelope 60 for sealing the envelope 60 closed. Thereafter, the envelope 60 is in condition for remailing to the return addressee. The receipt portion 46 may also be removed from remaining portions 48 and 36 of the sheet 12 for use as a receipt by the recipient.

An apparatus 100 for folding and gluing a sheet of paper 10, such as shown in FIG. 1, in order to form a mailer product in accordance with the present invention, will now be described. The apparatus, as shown in FIG. 9, comprises a glue application system 110, a buckle-chute folder 120, and a delivery system 130.

The delivery system 130, which is the object of related U.S. patent application Ser. No. 07/610,838, the disclosure of which is incorporated herein by reference, includes a conveyor 132 attached at the infeed of the folder 120. The conveyor 132 includes skewed rollers 134 and ball rollers 136. Skewed rollers 134 are rotatably driven by drive means (not shown), while the ball rollers 136 are rotatably mounted in a fence 138 positioned above the skewed rollers 134. Due to the angle at which the skewed rollers 134 are mounted, the rollers 134 act to urge incoming sheets 10 towards the fence 138. The sheets 10 are nipped between the ball rollers 136 and the driven skewed rollers 134 for advancement toward the infeed of the folder 120.

Figure 9:
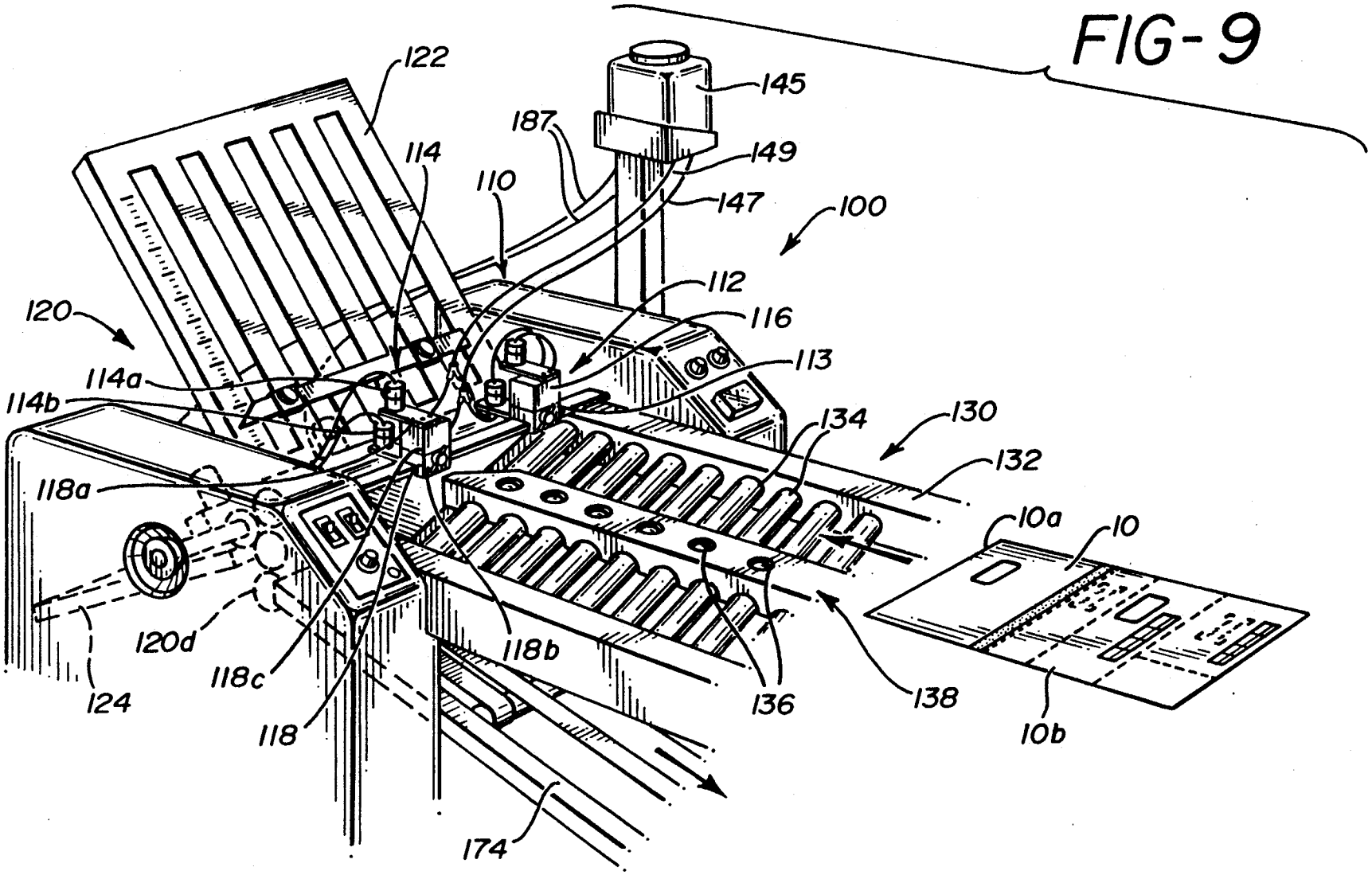
FIG. 9 is a perspective view illustrating a buckle-chute gluer/folder apparatus for folding and gluing a single sheet of paper to form the one-piece mailer of the present invention.

The glue application system 110 includes first and second separate gluer arrangements 112 and 114, respectively, which are spaced-apart from one another and positioned above the conveyor 132, as shown in FIG. 9. First and second mounting bracket arrangements 116 and 118, respectively, serve to adjustably support the first and second gluer arrangements 112 and 114 on a support bar 113 above the conveyor 132. The support bar 113 is fixedly connected to the folder by conventional fastener means (not shown).

Figure 10:
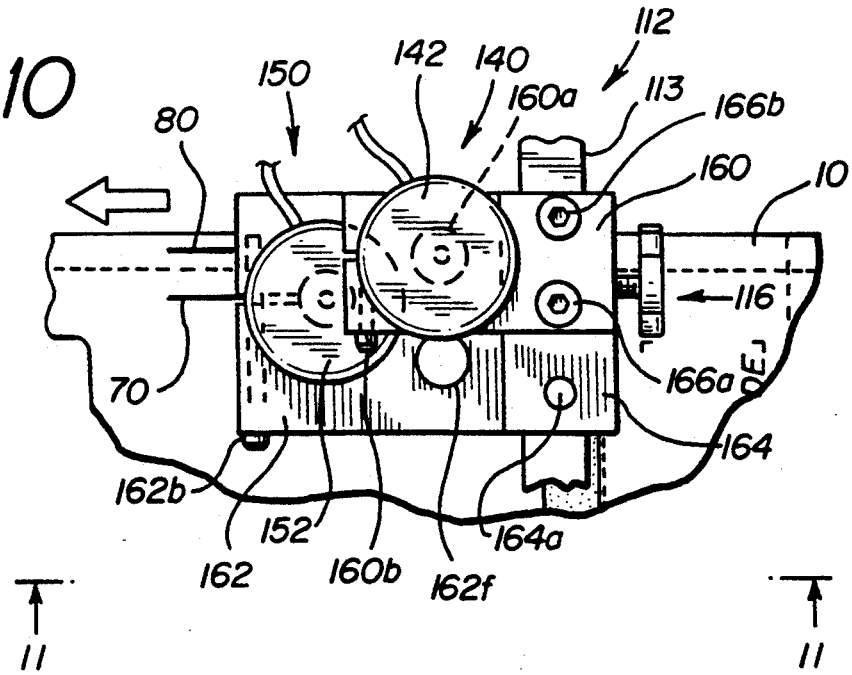
FIG. 10 is a top, plan view of first and second gluers shown in FIG. 9.
Figure 11:
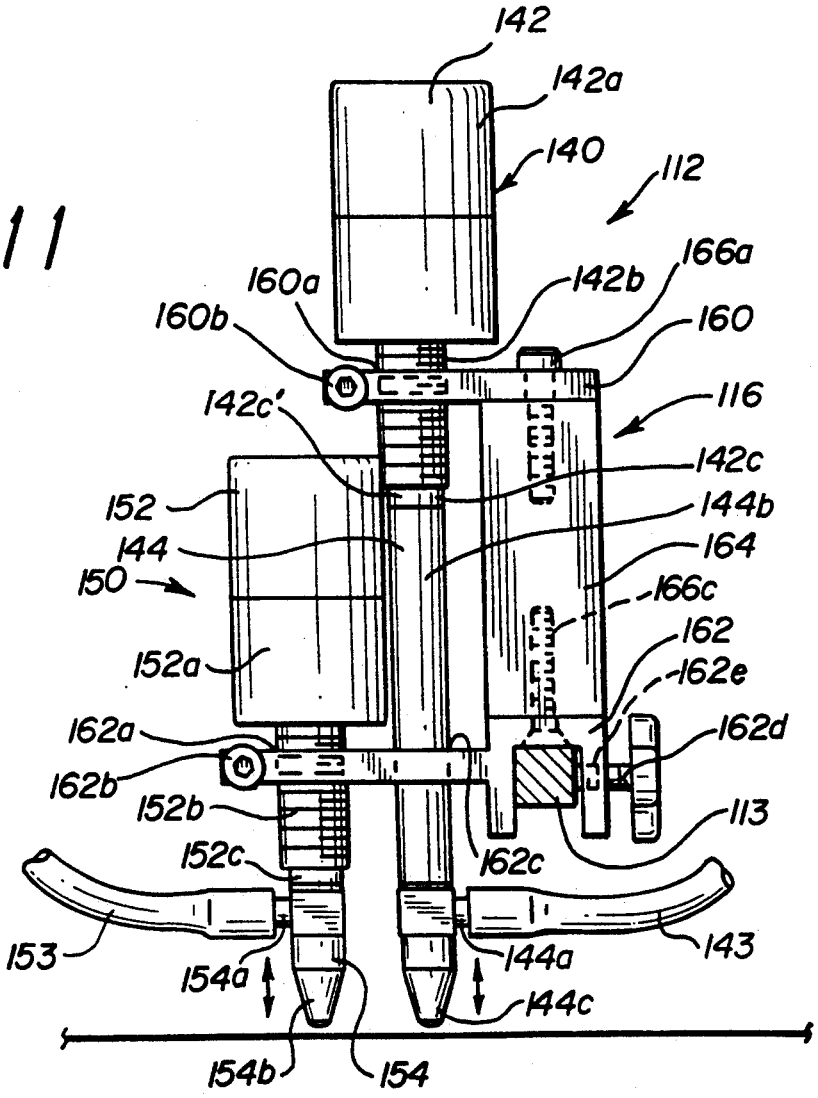
FIG. 11 is side view taken generally along line 11—11 in FIG. 10.

Referring now to FIGS. 10 and 11, the first gluer arrangement 112 comprises first and second gluers 140 and 150, which are also referred to herein as first and second glue means, which serve to apply two closely spaced lines of adhesive 80 and 70 on a sheet of paper 10. The first gluer 140, as best shown in FIG. 11, comprises a solenoid actuator 142 having an outer casing 142*a* with a threaded end portion 142*b* fixedly connected thereto. Extending from the casing 142*a* and passing through the threaded end portion 142*b* is a piston 142*c* having an end portion 142*c*′ with a threaded opening therein. A nozzle 144 is connected to the piston 142*c* for reciprocating movement therewith. The nozzle 144 includes a glue input connector 144*a* threadedly connected with an extension portion 144*b* which, in turn, is connected to the piston 142*c* via a threaded end portion which is received within the threaded opening of the piston 142.

The nozzle 144 receives glue or adhesive material via a glue line 143 which is mounted over the glue input connector 144*a* of the nozzle 144, as shown in FIG. 11. The glue line 143 is also connected to an intermediate glue line 147 which is gravity fed with glue or adhesive material from a glue supply 145, see FIG. 9. The nozzle 144 further includes a spring loaded ball tip 144*c* which allows glue to flow out from the nozzle 144 when the tip 144*c* makes contacts with a workpiece. Therefore, when the solenoid 142 is actuated by control means (not shown), the piston 142*c*, and hence the nozzle 144, are driven in a direction toward the paper 10 causing the spring loaded ball tip 144*c* to make contact with the paper 10. Upon making contact with the paper 10, the tip 144*c* applies a line of glue or adhesive material 80 onto the sheet 10, as shown in FIG. 10.

Referring again to FIG. 11, the second gluer 150 comprises a solenoid actuator 152 having an outer casing 152*a* with a threaded end portion 152*b* fixedly connected thereto. Extending from the casing 152*a* and passing through the threaded end portion 152*b* is a piston 152*c* having an end portion with a threaded opening therein. A nozzle 154 is connected to the piston 152*c* for reciprocating movement therewith via a threaded end portion which is received within the threaded opening of the piston 152*c*.

The nozzle 154 receives glue or adhesive material via a glue line 153 which is mounted over a glue input connector 154*a* of the nozzle 154, as shown in FIG. 11. The glue line 153 is also connected with an intermediate glue line 149, which is gravity fed with glue from the glue supply 145. The nozzle 154 further includes a spring loaded ball tip 154*b* which allows glue to flow from the nozzle 154 when the tip 154*b* makes contacts with a workpiece. Thus, when the solenoid 152 is actuated by the control means, the piston 152*c*, and hence the nozzle 154, are driven in a direction toward the paper 10 causing the spring loaded ball tip 154*b* to make contact with the paper 10. Upon making contact with the paper 10, the tip 154*b* applies a line of glue or adhesive material 70 on the sheet 10, as shown in FIG. 10.

The first and second gluers 140 and 150 are mounted in a staggered relationship, as shown in FIGS. 10 and 11, via the first mounting bracket arrangement 116 to permit the gluers 140 and 150 to apply the lines of adhesive 80 and 70 in close proximity to one another. The mounting bracket arrangement 116 comprises an upper bracket 160, a lower bracket 162, and an intermediate support bracket 164. The upper and lower brackets 160 and 162 are connected to the intermediate bracket 164 via fasteners 166*a*, 166*b* and 166*c*, as shown in FIGS. 10 and 11.

The upper bracket 160 includes a threaded opening 160*a* therein for threadedly receiving end portion 142*b* of solenoid 142. A locking bolt 160*b* is received within the upper bracket 160 and extends across a portion of the opening 160*a* for locking the end portion 142*b* in position. The lower bracket 162 likewise includes an opening 162*a* therein for threadedly receiving end portion 152*b* of solenoid 152. A locking bolt 162*b* is received within the lower bracket 162 and extends across a portion of the opening 162*a* for locking the end portion 152*b* in position. The lower bracket 162 also includes an opening 162*c* through which the nozzle 144 extends.

The mounting bracket arrangement 116 is movable along the cross bar 113 to allow for proper positioning of the gluers 140 and 150 over the conveyor 132. A locking screw 162*d* passes through an opening 162*e* in the lower portion 162 for frictionally engaging with the cross bar 113 to lock the mounting bracket arrangement 116, and hence the gluers 140 and 150, in position along the cross bar 113.

The second gluer arrangement 114 likewise includes two gluers 114*a* and 114*b* mounted on the bar 113 in a staggered relationship via the second mounting bracket arrangement 118, as shown in FIG. 9. Gluer 114*a* is constructed in essentially the same manner as gluer 140, and gluer 114*b* is constructed in essentially the same manner as gluer 150. Consequently, reference is made to the discussion above regarding gluers 140 and 150 for a detailed explanation of the construction of gluers 114*a* and 114*b*.

The second mounting arrangement 118 mounts the gluers 114*a* and 114*b* in a staggered relationship to permit the gluers 114*a* and 114*b* to apply two lines of adhesive 82 and 72 (see FIG. 1 or 4) in close proximity to one another. The second mounting arrangement 118 is constructed in essentially the same manner as the first mounting arrangement 116, and includes an upper mounting bracket 118a, a lower mounting bracket 118b and an intermediate mounting bracket 118c. The lower bracket 118b is mounted to the intermediate bracket 188c in essentially the same manner that the bracket 162 is mounted to bracket 164, as shown in FIG. 11. The upper bracket 118a is mounted to the intermediate bracket 118c so that gluer 114a is positioned closer to the outer edge 10b of the sheet than gluer 114b.

Brackets 160, 162 and 164 may be substituted for brackets 118a–188c. The upper bracket 160, however, would be mounted to the intermediate bracket 164 so that fastener 166b passes through threaded opening 164a in intermediate section 164. As a result, the nozzle of the first gluer 114a would pass through opening 162f in the lower bracket 162 rather than through opening 162c.

Figure 12:
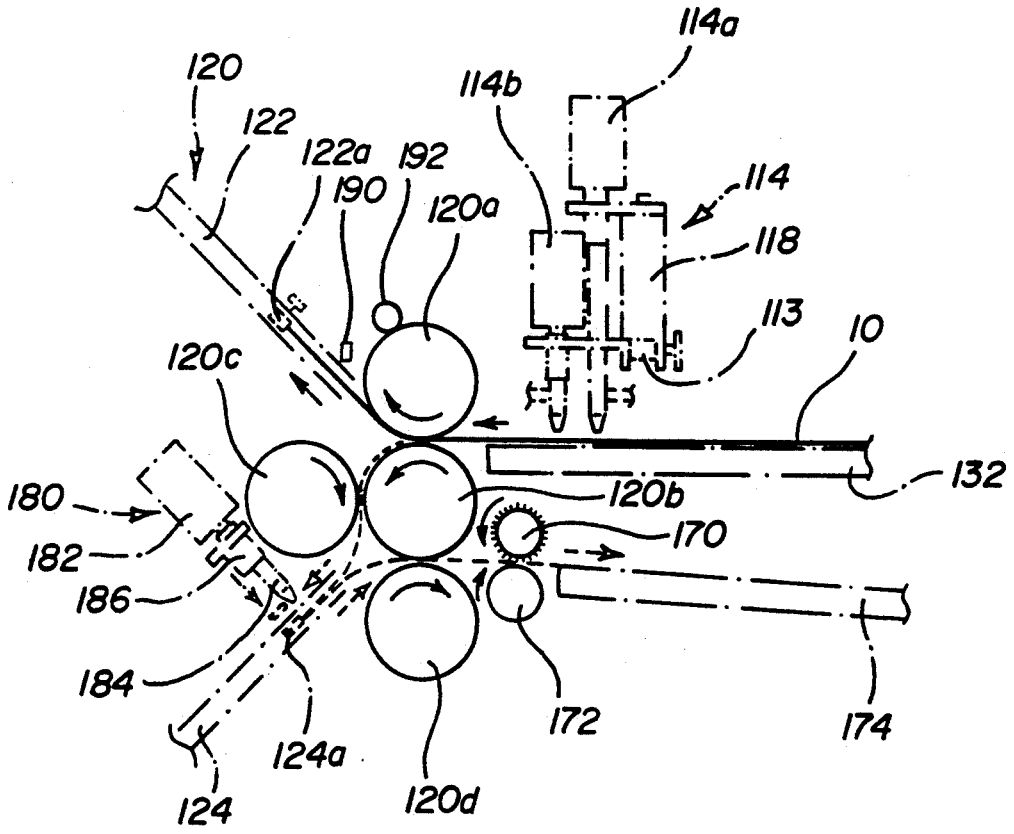
FIG. 12 is a schematic side view showing the location of the glue system of the present invention within the buckle-chute folder/gluer of FIG. 9.

The folder 120, as shown in FIGS. 9 and 12, is a buckle chute folder having four fold rollers 120a–120d, first and second fold pans 122 and 124, and two sets of cutter and anvil rollers 170 and 172 (only one set is shown in FIG. 12). Such a folder is commercially available from Baumfolder, Inc., in Sidney, Ohio.

Operation of the apparatus 100 for gluing and folding a sheet of paper 10 to make a folded mailer 12, as shown in FIG. 3, will now be explained. The conveyor 132 receives a sheet of paper 10 and transports the same past the first and second gluer arrangements 112 and 114 to the infeed of the folder 120. A photo-cell 190 may be provided for sensing the incoming or front edge 10a of the sheet. A counterwheel 192 may likewise be provided for counting, after the incoming edge 10a is sensed by the photo-cell 190, the length of the sheet 10 that has past under the first and second gluer arrangements 112 and 114. A conventional controller (not shown) is connected to the photo-cell 190 and to the counterwheel 192 and receives the signals output by these two sensors. Based upon these signals, the controller controls the actuation of the solenoids associated with gluers 140, 150, 114a and 114b so as to form lines of adhesive 70, 72, 80, and 82 on each sheet 10, as shown in either FIG. 1 or FIG. 4.

As the front edge 10a of the sheet 10 passes the first and second gluer arrangements 112 and 114, first and second rollers 120a and 120b of the folder 120 grasp the sheet 10 and move it into the first fold pan 122. After the front edge 10a of the sheet 10 hits a stop bar 122a in the pan 122, the sheet 10 buckles along a first transverse line 50. The second roller 120b and the third roller 120c then grasp the sheet 10 along the first transverse line 50 and fold the sheet 10 along the line 50 to form the return envelope 60, as shown in FIG. 2. The rollers 120b and 120c further serve to move the sheet 10 into the second fold pan 124.

Just after the folded edge at line 50 of the sheet 10 hits a stop bar 124a in the second fold pan 124, a third gluer arrangement 180, shown in FIG. 12, acts to apply adhesive material 81 on the sheet 10 in a manner as shown in FIG. 2. The third gluer arrangement 180 includes two or more solenoids 182 (only one is shown in FIG. 12) and a plurality of nozzles 184 (only one is shown) connected, for example, by a manifold 186 and glue lines 187 to the glue source 145, for applying the adhesive material 81 onto the sheet 10.

After the folded edge at line 50 of the folded sheet 10 hits the stop bar 124a, the sheet 10 buckles for a second time along a second transverse line 52. The second roller 120b and a fourth roller 120d grasp the sheet 10 as it buckles and fold it along the second transverse line 52 to form the closed mailer 12, as shown in FIG. 3. The rollers 120b and 120d further serve to move the sheet 10 into the two sets of cutter and anvil rollers 170 and 172 which serve to cut perforation lines 13 and 14 into the mailer 12 just before the mailer 12 is ejected onto a tray 174.

Thus, by the present invention a mailer product is produced from a single sheet of paper material which is folded after being printed upon and after having adhesive material applied thereto. Also in accordance with the present invention, a folder/gluer is employed for applying adhesive material onto a single sheet of paper and thereafter folding the sheet into the mailer product of the present invention.

Having described the invention in detail and by reference to preferred embodiments thereof, it will be apparent that modifications and variations are possible without departing from the scope or the invention defined in the appended claims.

What is claimed is:

1. A one-piece mailer comprising:

a single sheet of paper having first, second and third sections, said first and second sections being separated by a first transverse line and said second and third sections being separated by a second transverse line, said sheet of paper being foldable along said first and second transverse lines so that said first section overlies said second section and said third section overlies said first and second sections;

first securing means on one of said first and said second sections for securing said first and said second sections to one another when said sheet is folded along said first transverse line to form a return envelope;

second securing means located on at least one of said first, second and third sections for securing said third section to at least one of said first and said second sections when said sheet is folded along said second transverse line to form a closed mailer; and wherein said second section includes a first severance line extending across its width and spaced parallel to said first and second transverse lines for defining first and second portions of said second section, said first portion including a sealing panel and a first side of said return envelope and said second portion including an initial addressee portion having initial addressee information printed thereon, said return envelope being severable from said second portion of said second section along said first severance line.

2. A one-piece mailer as set forth in claim 1, wherein said first section defines a second side of said return envelope and said sealing panel includes third securing means thereon for securing said sealing panel to said second side of said return envelope for sealing said return envelope closed.

3. A one-piece mailer as set forth in claim 1, wherein said third section includes a severance line for defining a return portion and a window portion, said return portion having return addressee information printed thereon and said window portion having a window through which an initial addressee portion is visible when said third section overlies said first and said second sections.

4. A one-piece mailer as set forth in claim 3, wherein said return portion further includes payment information printed thereon, and said window portion further includes receipt information printed thereon.

5. A one-piece mailer as set forth in claim 1, wherein said single sheet of paper further includes first and second outer longitudinal tear lines spaced from opposite first and second side edges of said sheet.

6. A one-piece mailer as set forth in claim 5, wherein said first securing means comprises first and second lines of adhesive located on said second section, said first line of adhesive being positioned inwardly of and adjacent to said first longitudinal tear line and said second line of adhesive being positioned inwardly of and adjacent to said second longitudinal tear line.

7. A one-piece mailer as set forth in claim 6, wherein said second securing means comprises third and fourth lines of adhesive located on said third section for detachably securing said third section to said first and second sections, said third line of adhesive being positioned intermediate said first longitudinal tear line and said first side edge of said sheet and said fourth line of adhesive being positioned intermediate said second longitudinal tear line and said second side edge of said sheet.

8. A one-piece mailer as set forth in claim 7, wherein each of said third and fourth lines of adhesive further extend onto at least a portion of said second section.

9. A one-piece mailer as set forth in claim 10, wherein said second securing means further comprises adhesive material located on a back surface of said first section.

* * * * *

UNITED STATES PATENT AND TRADEMARK OFFICE

CERTIFICATE OF CORRECTION

PATENT NO. : 5,288,014
DATED : February 22, 1994
INVENTOR(S) : Richard Meyers and Nelson Lusiner It is certified that error appears in the above-indentified patent and that said Letters Patent is hereby corrected as shown below:

Col. 12, Line 11, "in Claim 10" should be --in Claim 7--.

Signed and Sealed this

Twenty-sixth Day of July, 1994

*Attest:*

Bruce Lehman

BRUCE LEHMAN

*Attesting Officer*

*Commissioner of Patents and Trademarks*